US010801172B2

(12) United States Patent
Moorman

(10) Patent No.: US 10,801,172 B2
(45) Date of Patent: Oct. 13, 2020

(54) SNOW PLOW ASSEMBLY WITH FLOATING A-FRAME

(71) Applicant: Buyers Products Company, Mentor, OH (US)

(72) Inventor: Scott Moorman, Concord Township, OH (US)

(73) Assignee: Buyers Products Company, Mentor, OH (US)

( * ) Notice: Subject to any disclaimer, the term of this patent is extended or adjusted under 35 U.S.C. 154(b) by 272 days.

(21) Appl. No.: 15/899,584

(22) Filed: Feb. 20, 2018

(65) Prior Publication Data

US 2019/0257047 A1 Aug. 22, 2019

(51) Int. Cl.
*E01H 5/06* (2006.01)

(52) U.S. Cl.
CPC ..... *E01H 5/066* (2013.01)

(58) Field of Classification Search
CPC ..... E01H 5/066; E02F 9/003; E02F 3/7609; E02F 3/76; E02F 3/7627; E02F 3/7631
See application file for complete search history.

(56) References Cited

U.S. PATENT DOCUMENTS 1,920,475 A * 8/1933 Meyer ..... E01H 5/06 37/231
1,964,617 A * 6/1934 Bird ..... E02F 3/7613 37/232
4,281,847 A * 8/1981 Robe ..... B60D 1/243 280/455.1
4,342,163 A * 8/1982 Hoekstra ..... E01H 5/06 172/274
4,596,081 A * 6/1986 DeBilly ..... E01H 5/067 37/281
5,148,617 A * 9/1992 Feller ..... E01H 5/067 172/739
5,638,618 A * 6/1997 Niemela ..... E01H 5/065 37/281
5,950,336 A * 9/1999 Liebl ..... E01H 5/06 37/231
6,154,986 A * 12/2000 Hadler ..... E01H 5/06 172/810
6,170,178 B1 * 1/2001 Christy ..... E01H 5/06 172/272

(Continued)

*Primary Examiner* — Jamie L McGowan
(74) *Attorney, Agent, or Firm* — Renner, Otto, Boisselle & Sklar, LLP

(57) ABSTRACT

A snow plow assembly having a push frame, a lift frame, and a coupling configured to floatably attach the push frame to a lift frame. The coupling may attach the left and right sides of the push frame to the corresponding left and right sides of the lift frame, and each coupling may be independently vertically floatable to allow the push frame to float vertically relative to the lift frame, while also allowing the push frame to rotate relative to the lift frame to accommodate for irregular or uneven ground surfaces. The couplings may each include a retaining member for operatively coupling the push frame to the lift frame, and one or more bearing blocks that facilitate distribution of load between the push frame and retaining member to reduce wear on the push frame. The bearing blocks also may be vertically movable relative to the push frame for common vertical movement with the retaining members to enable such floating movement.

20 Claims, 11 Drawing Sheets

(56) References Cited

U.S. PATENT DOCUMENTS

| | | | | |
|---|---|---|---|---|
| 6,178,669 | B1 * | 1/2001 | Quenzi | E01H 5/06 172/275 |
| 6,393,737 | B2 * | 5/2002 | Quenzi | E01H 5/06 37/231 |
| 6,928,757 | B2 | 8/2005 | Bloxdorf et al. | |
| 7,089,692 | B2 * | 8/2006 | Strait | E01H 5/063 172/261 |
| 7,491,027 | B1 * | 2/2009 | McFarland | E02F 3/3604 37/468 |
| 7,562,718 | B1 * | 7/2009 | Moorman | E02F 3/3631 172/272 |
| 7,588,092 | B2 * | 9/2009 | Liebl | E01H 5/06 172/811 |
| 7,805,862 | B2 * | 10/2010 | Osgood | E01H 5/066 172/272 |
| 7,805,866 | B1 * | 10/2010 | Osgood | E01H 5/066 172/784 |
| 8,850,724 | B2 * | 10/2014 | Bloxdorf | E01H 5/067 172/815 |
| 10,119,233 | B2 * | 11/2018 | Holman | E01H 5/062 |
| 2007/0271828 | A1 * | 11/2007 | Mishra | E01H 5/06 37/231 |
| 2008/0053673 | A1 * | 3/2008 | Dilworth | E01H 5/06 172/246 |

* cited by examiner

SNOW PLOW ASSEMBLY WITH FLOATING A-FRAME

FIELD OF INVENTION

The present invention relates generally to snow plows, and more particularly to snow plow assemblies having a floating A-frame.

BACKGROUND

Snow plow assemblies are used on commercial, residential, or all-purpose vehicles for the effective removal of snow from the ground. A typical snow plow assembly includes a mounting frame coupled to a moldboard assembly for plowing the snow, a push frame pivotably connected to the mounting frame for allowing lateral pivoting movement of the mounting frame and moldboard assembly, and a lift frame operatively coupled to the push frame for vertically raising or lowering the push frame and the mounting frame. During the use of such snow plow assemblies, the vehicle and/or snow plow assembly may travel over irregular or uneven ground surfaces, which may cause uneven removal of snow from the ground. In addition, the snow plow assembly may experience a significant amount of pushing and pulling force during normal use, which can cause a significant amount of stress and wear on the snow plow assembly.

SUMMARY OF INVENTION

The present invention provides a snow plow assembly having a push frame, a lift frame, and a coupling configured to floatably attach the push frame to a lift frame. The coupling may attach the left and right sides of the push frame to the corresponding left and right sides of the lift frame, and each coupling may be vertically floatable independently of one another to allow the push frame to float vertically relative to the lift frame, while also allowing the push frame to rotate about a longitudinal axis relative to the lift frame. Such vertical and/or rotational movement of the push frame relative to the lift frame enables the snow plow assembly to improve snow removal by accommodating for irregular or uneven ground surfaces when the snow plow assembly is in use.

At least one of the couplings may include a retaining member for operatively coupling the push frame to the lift frame, and one or more bearing blocks that facilitate distribution of load exerted on the push frame when in use. For example, the bearing block may be configured to have bearing surfaces that enhance the distribution of load between the push frame and the retaining member to reduce the concentration of stresses and wear on the push frame. The bearing block may be a sacrificial wear component that preferentially allows wear of the bearing block, while minimizing wear on the more expensive push frame component, and provides for the wear block to be easily replaceable when significant wear has occurred. The bearing block also may be slidably movable against the push frame for common movement with the retaining member to allow the coupling to float vertically with respect to the push frame.

According to an aspect of the invention, a snow plow assembly for a vehicle includes: a push frame to which a moldboard is mountable for enabling removal of snow; a lift frame configured for mounting to the vehicle; a lift device mounted to the lift frame, the lift device configured to vertically raise or lower the push frame and the moldboard relative to a horizontal plane; and a first coupling and a second coupling, the first coupling attaching a left side of the push frame to a corresponding left side of the lift frame, and the second coupling attaching a right side of the push frame to a corresponding right side of the lift frame; wherein the respective first and second couplings are configured to allow each of the left and right sides of the push frame to float vertically relative to the respective left and right sides of the lift frame, and are configured to allow the left and right sides of the push frame to float vertically independently of one another, thereby allowing the push frame to rotate relative to the lift frame about a longitudinal axis extending in a forward direction, which enables the snow plow assembly to accommodate for irregular or uneven ground surfaces when the snow plow assembly is in use.

According to another aspect of the invention, a snow plow assembly for a vehicle includes: a push frame to which a moldboard is mountable for enabling removal of snow; a lift frame configured for mounting to the vehicle; a lift device mounted to the lift frame, the lift device configured to vertically raise or lower the push frame and the moldboard relative to a horizontal plane; and a coupling configured to couple the push frame to the lift frame, the coupling including a bearing block and a retaining member; wherein the retaining member is configured to operatively couple the push frame to the lift frame while permitting the push frame to float vertically relative to the lift frame, and wherein the bearing block is interposed between the retaining member and the push frame, the bearing block being configured to distribute at least some load exerted on the push frame to the retaining member, thereby reducing wear on the push frame when the snow plow assembly is in use.

According to another aspect of the invention, a snow plow assembly includes: a mounting bar having one or more mounting interfaces for coupling to a moldboard assembly; an A-frame having a forward vertex portion and left and right rearward portions laterally spaced apart in the transverse horizontal direction, the forward vertex portion having an interface for pivotably connecting a portion of the mounting bar for enabling lateral pivoting movement of the mounting bar relative to the A-frame; a lift frame having an upper portion that extends upright above the A-frame and the mounting bar, the upper portion having a forwardly extending lift arm connected to a lift device, the lift arm being operably connected to a portion of the A-frame, such that activation of the lift device vertically raises or lowers the A-frame and the mounting bar relative to a horizontal plane; and a first coupling and a second coupling, the first coupling attaching the left rearward portion of the A-frame to a corresponding left portion of the lift frame, and the second coupling attaching a right rearward portion of the A-frame to a corresponding right portion of the lift frame; wherein each of the first coupling and the second coupling include a bearing block and a retaining member, the respective bearing blocks and retaining members being configured to move vertically relative to the corresponding left and right rearward portions of the push frame to allow each of the left and right rearward portions of the push frame to float vertically relative to the corresponding left and right portions of the lift frame, and are configured to allow the left and right rearward portions of the push frame to float vertically independently of one another, thereby allowing the push frame to rotate relative to the lift frame about a longitudinal axis extending in a forward direction to accommodate for irregular or uneven ground surfaces when the snow plow assembly is in use; and wherein for each of the first coupling and the second coupling, the bearing block is interposed between the retaining member and the corresponding left or right rearward portion of the push frame, the respective bearing blocks being configured to distribute at least some load exerted on the push frame to the respective retaining members, thereby reducing wear on the push frame when the snow plow assembly is in use.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

DETAILED DESCRIPTION

The principles of the present invention have particular application to snow plow assemblies for a vehicle, including commercial, residential, or all-purpose vehicles, and will be described below chiefly in this context. It is also understood, however, that the principles of the present invention may be applicable to other plow assemblies or vehicle-mounted accessories for other applications where it is desirable to provide one or more couplings that allow a push frame to be floatably coupled to a lift frame for accommodating irregular or uneven ground surfaces; and/or where it is desirable to provide one or more bearing blocks in the coupling to improve the load distribution on the push frame to reduce wear.

Figure 1:
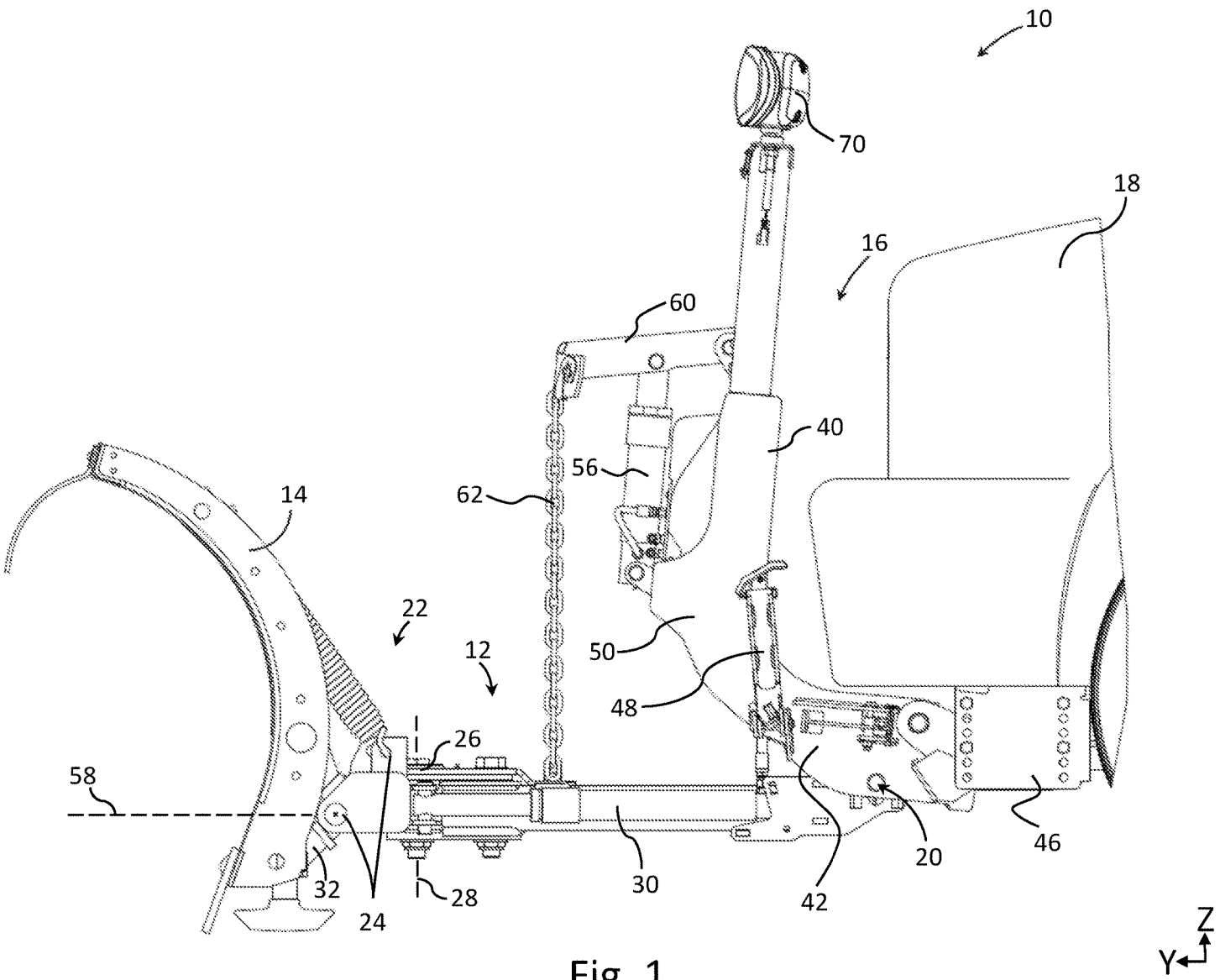
FIG. 1 is a side plan view of an exemplary snow plow assembly according to an embodiment of the invention.
Figure 2:
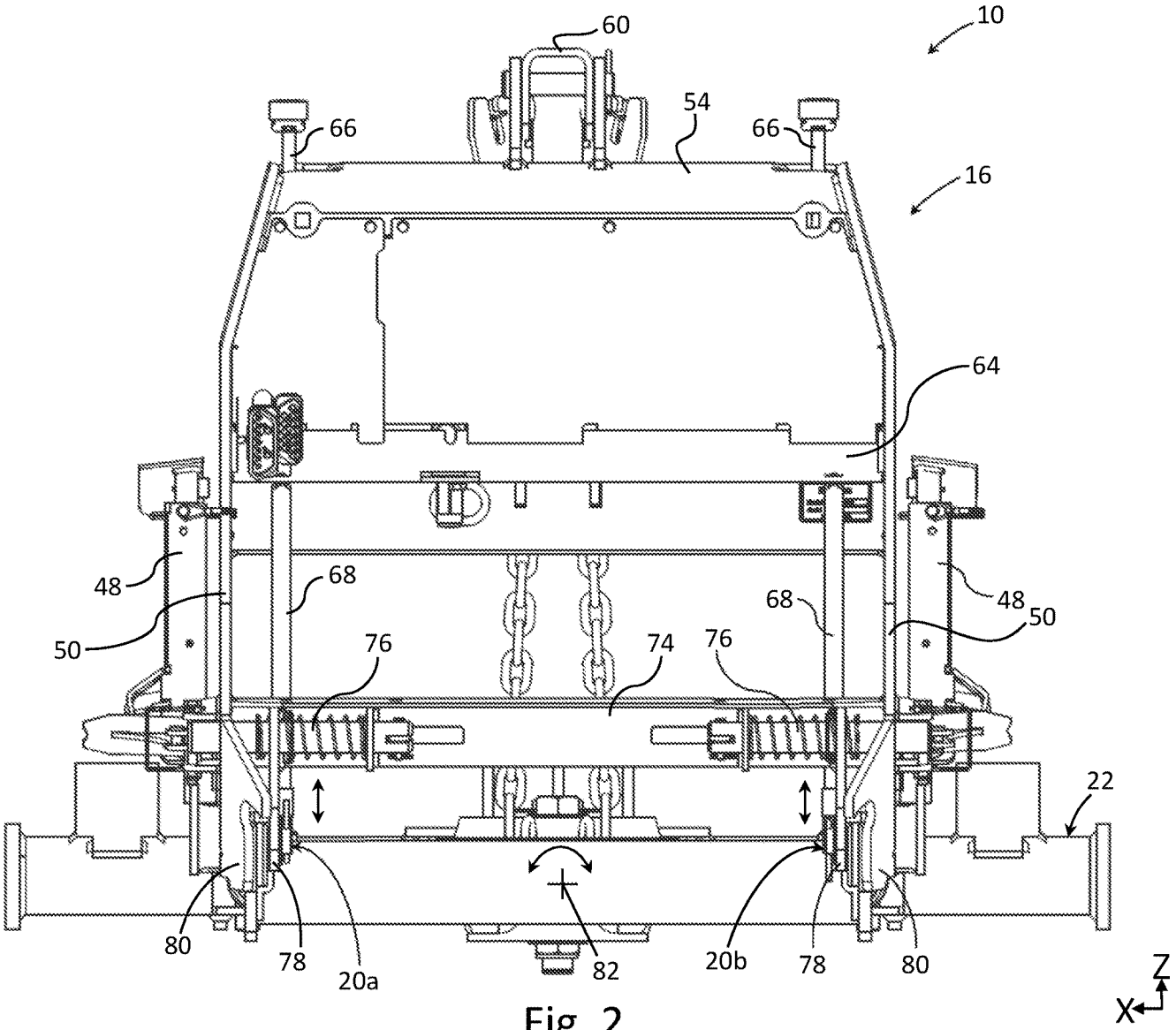
FIG. 2 is a rear plan view of the snow plow assembly.
Figure 3:
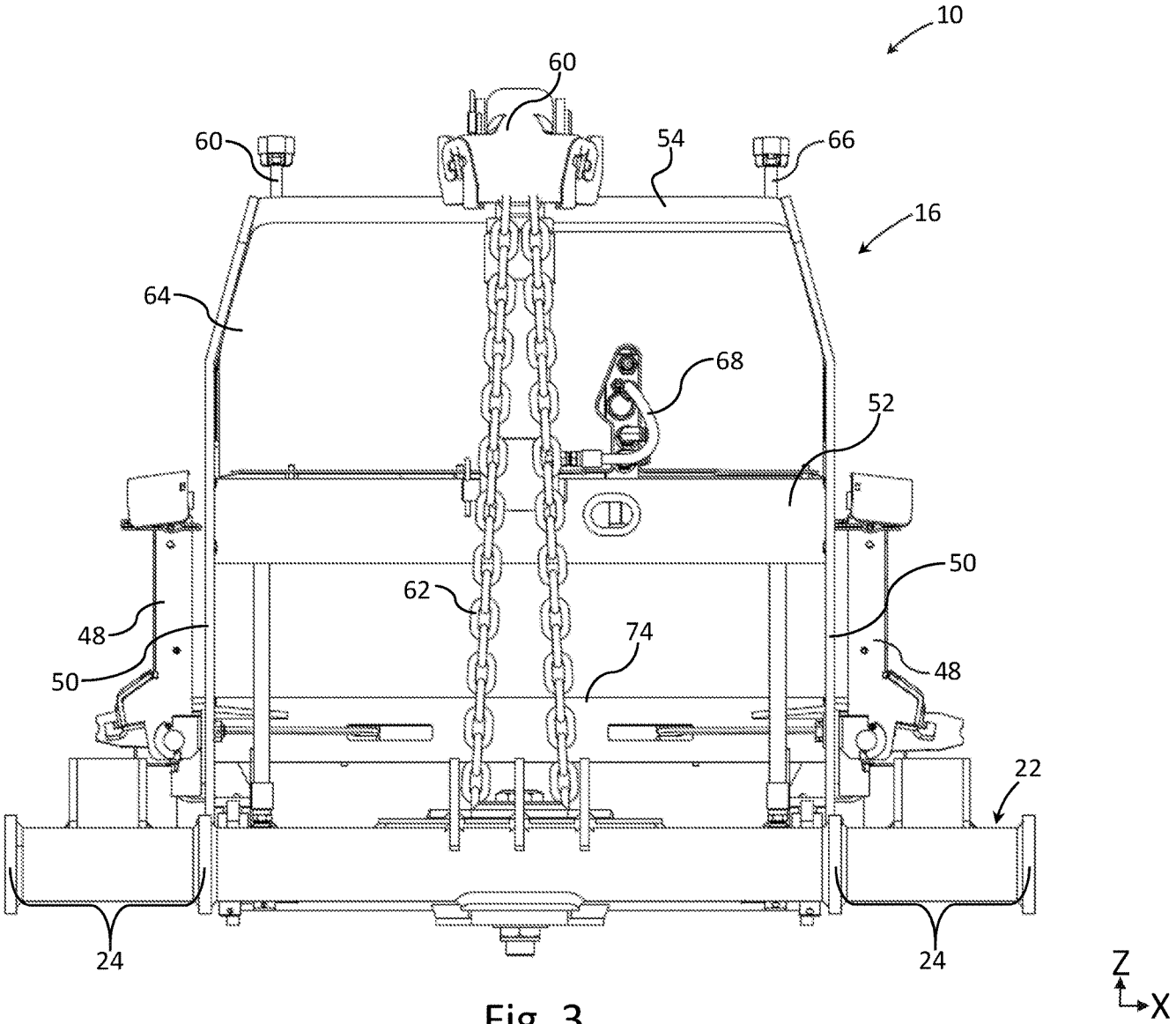
FIG. 3 is a front plan view of the snow plow assembly.
Figure 4:
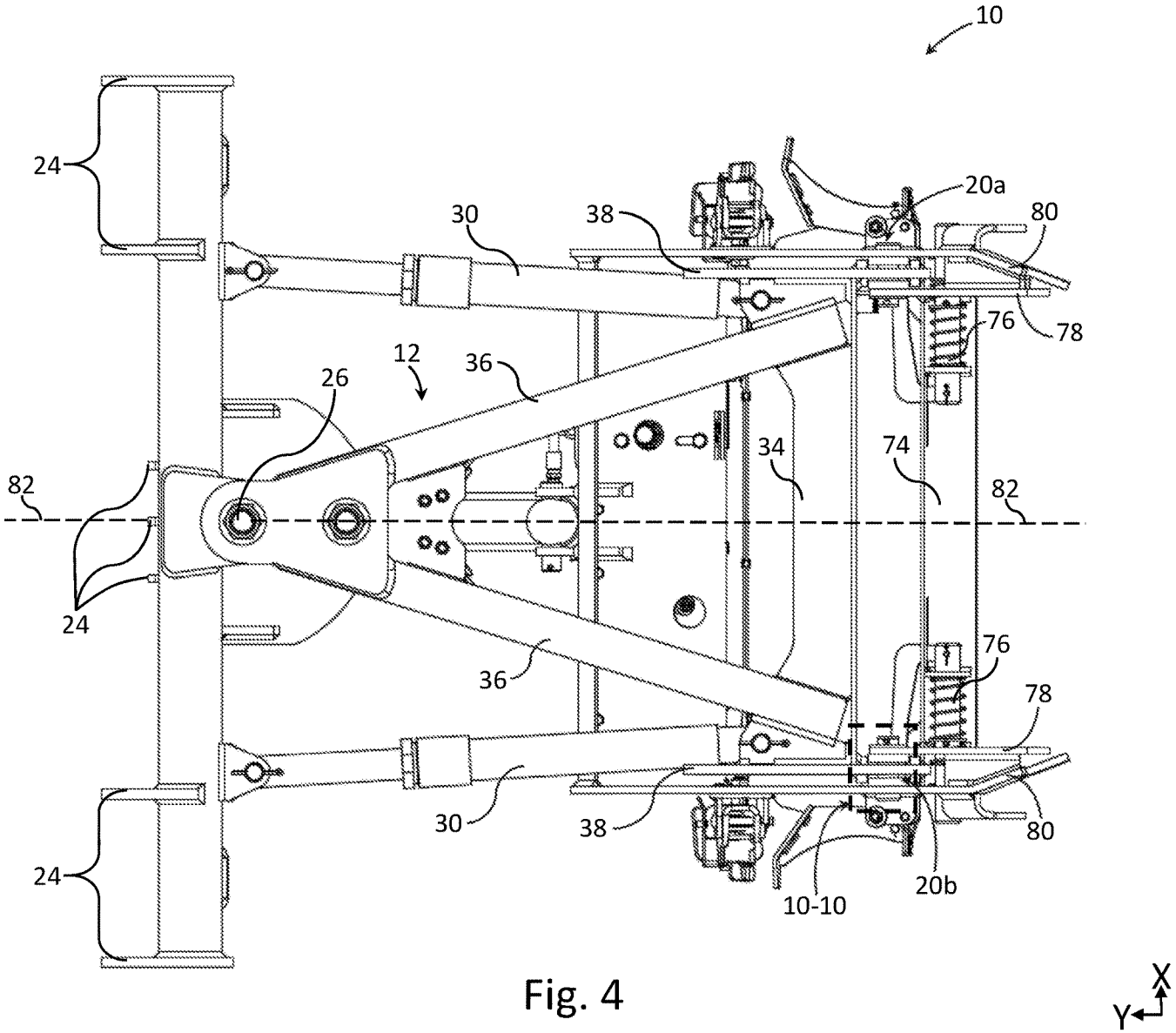
FIG. 4 is a bottom plan view of the snow plow assembly.
Figure 5:
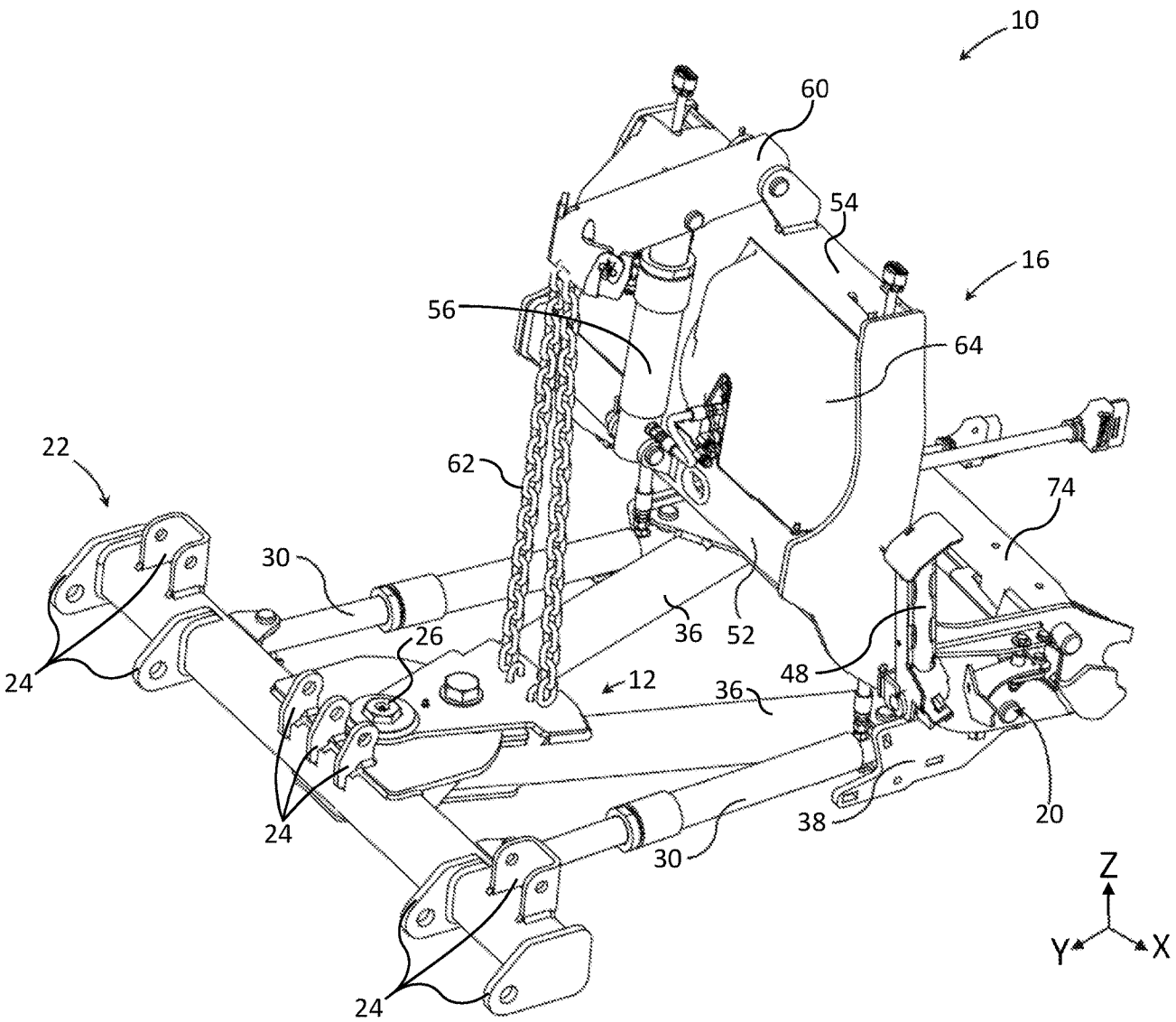
FIG. 5 is a front, top perspective view of the snow plow assembly.
Figure 6:
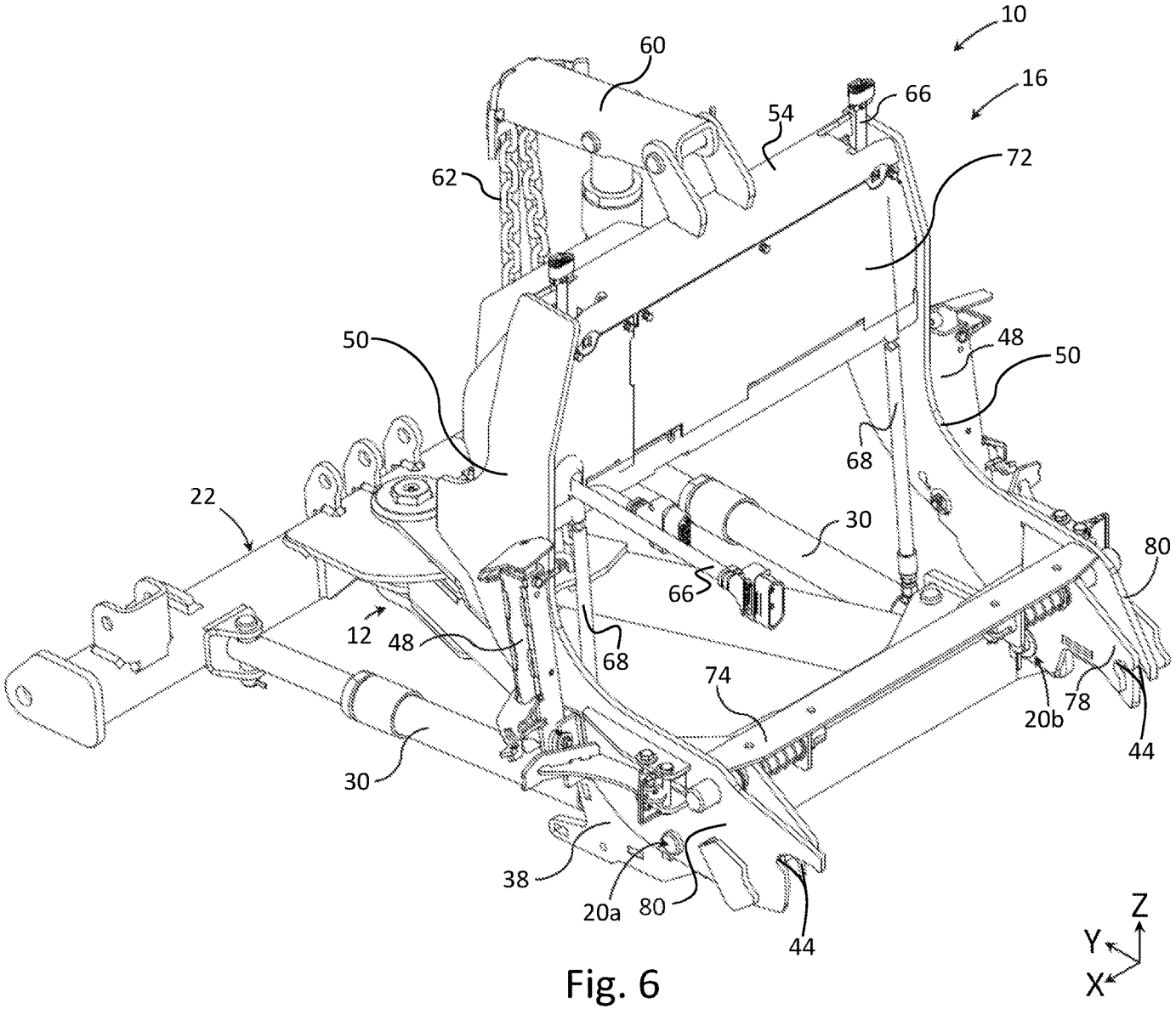
FIG. 6 is a rear, top perspective view of the snow plow assembly.
Figure 7:
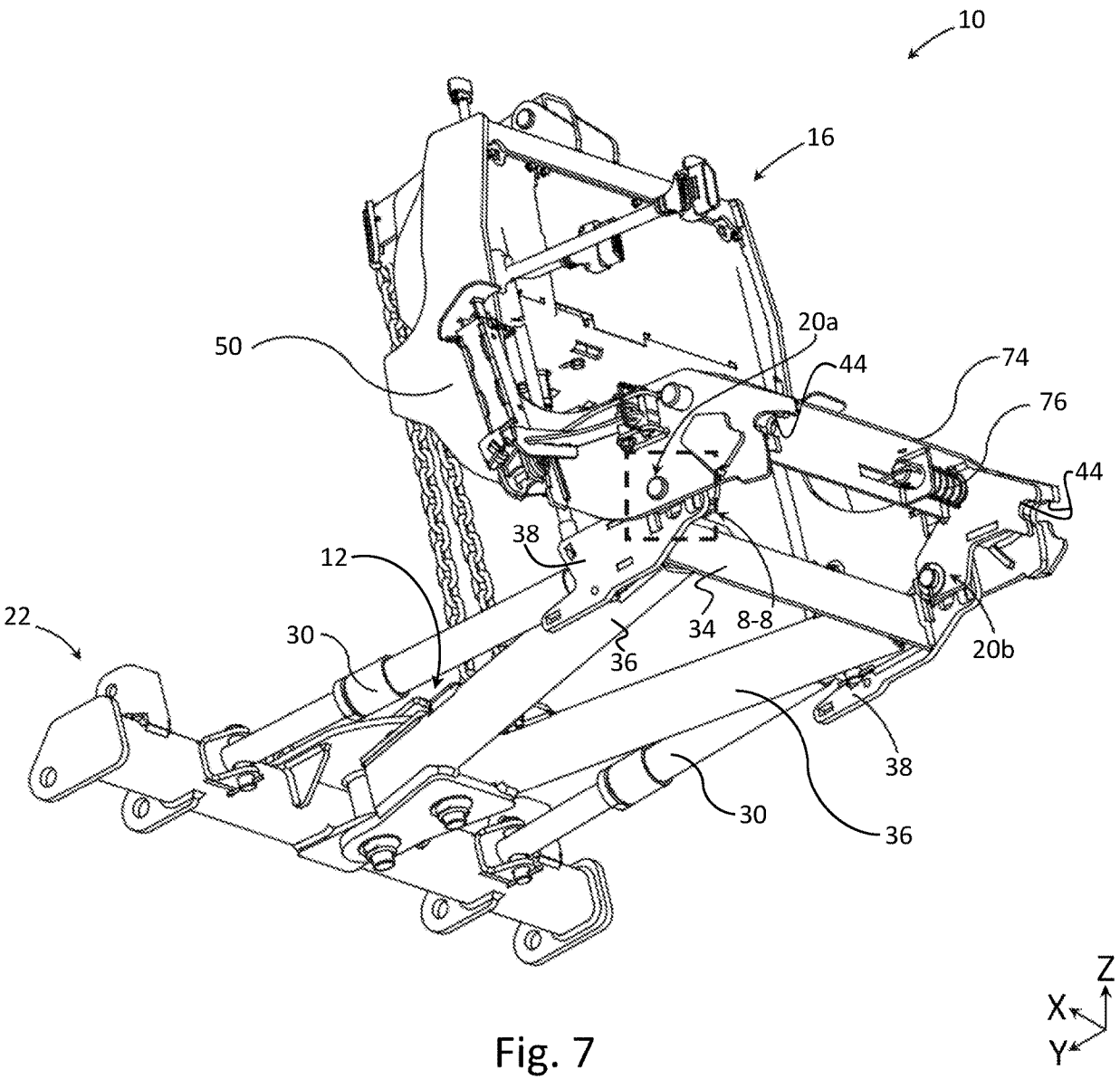
FIG. 7 is a rear, bottom perspective view of the snow plow assembly.
Figure 8:
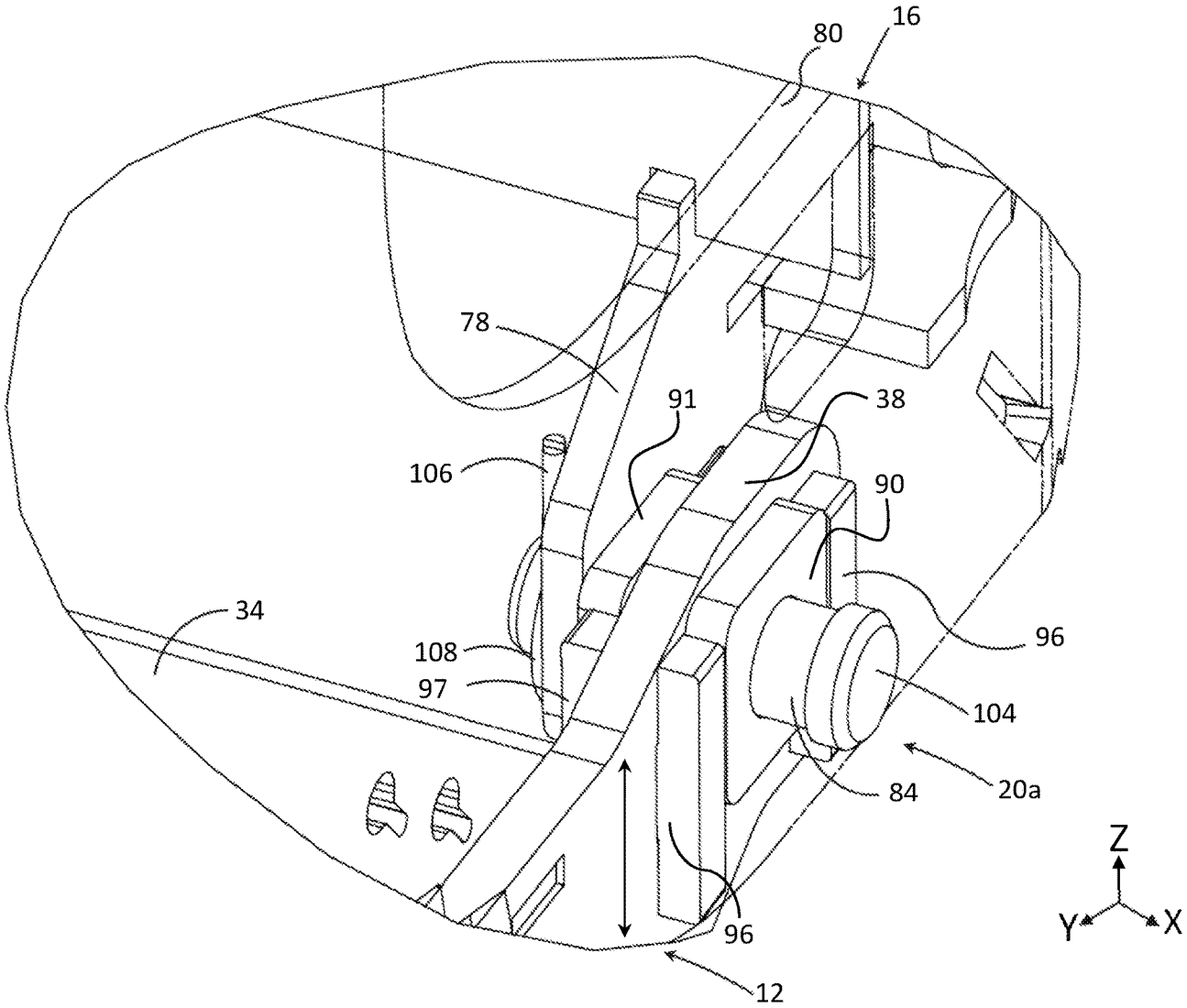
FIG. 8 is an enlarged front, top perspective view of section 8-8 in FIG. 7, which shows an exemplary coupling of the snow plow assembly, with an outer portion of the lift frame in transparent view.
Figure 9:
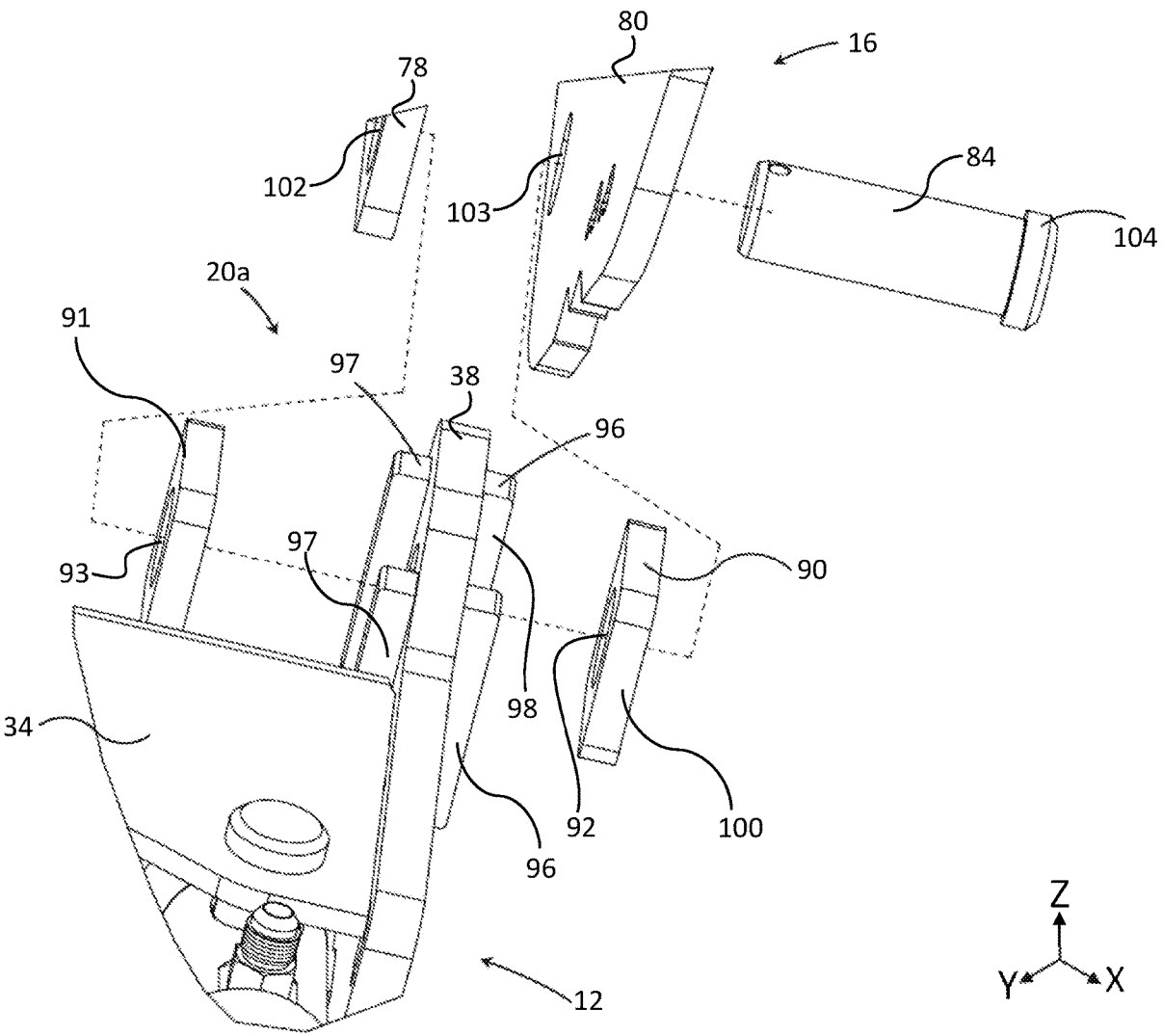
FIG. 9 is an exploded perspective view of the coupling in FIG. 8.
Figure 10:
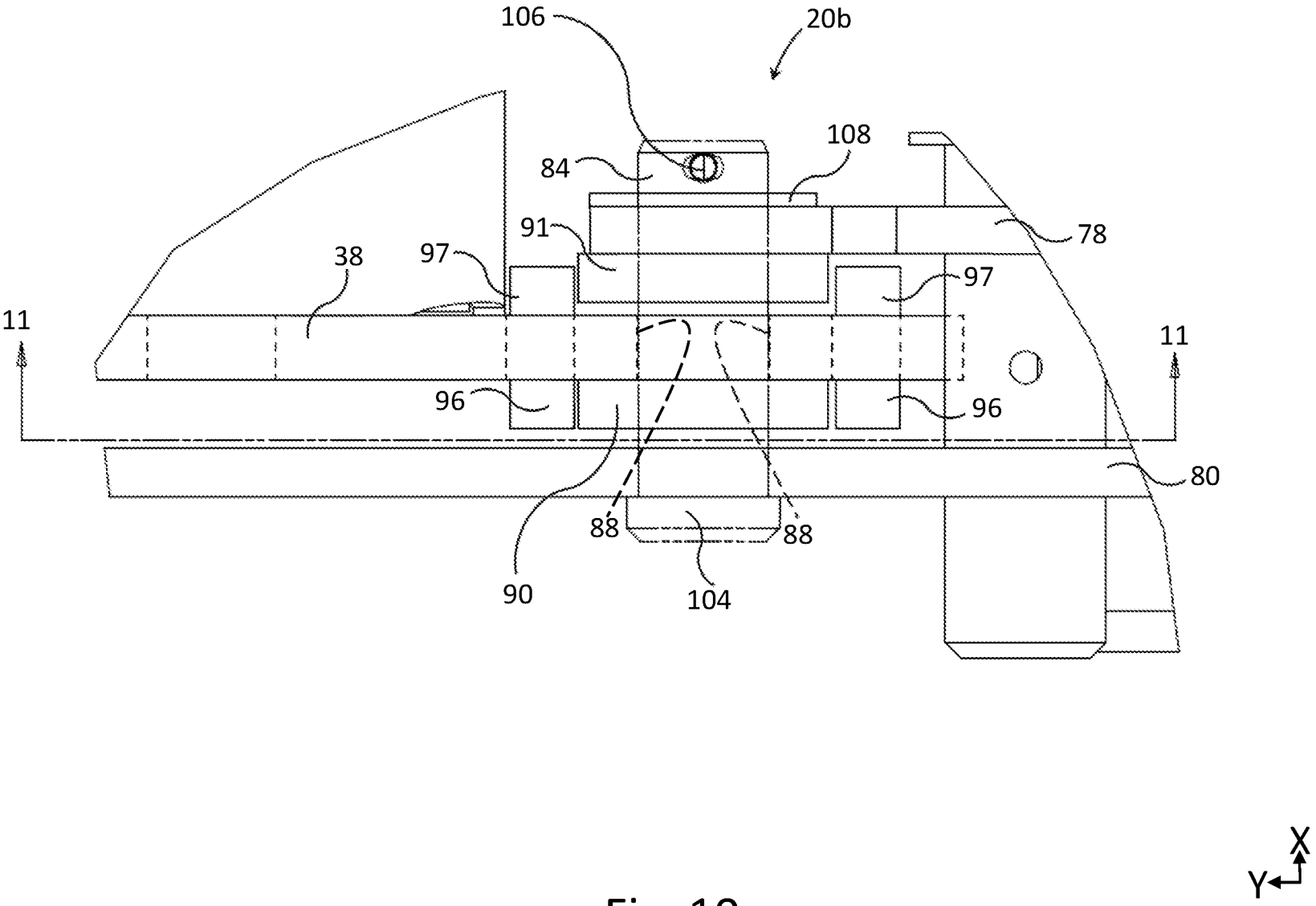
FIG. 10 is an enlarged bottom plan view of section 10-10 in FIG. 4.
Figure 11:
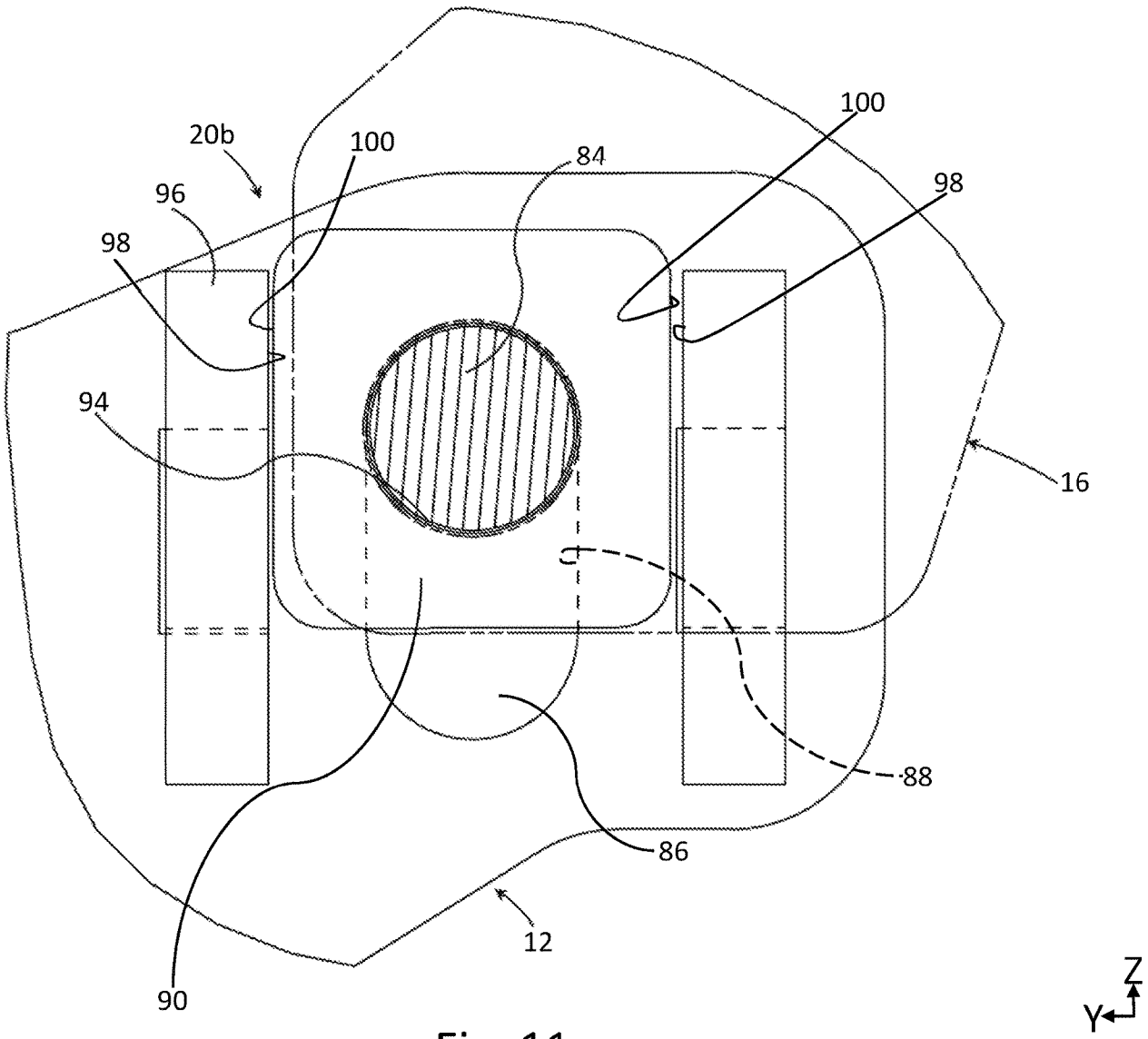
FIG. 11 is a cross-sectional side view taken about line 11-11 in FIG. 10, with an outer portion of the lift frame in transparent view.

In the discussion above and to follow, the terms "upper", "lower", "top", "bottom," "inner," "outer," "left," "right," "above," "below," "horizontal," "vertical," etc. refer to the snow plow assembly as viewed in a horizontal position, as shown in FIG. 1, for example. As generally used herein, and unless otherwise provided in a different context, the terms forward and rearward are used synonymously with being in a longitudinal direction of the snow plow assembly, which is generally designated in the Y-direction in the figures; the terms left and right are used synonymously with being in a transverse or lateral direction, which is generally designated in the X-direction in the figures; and the terms upwards, downwards, vertical, or the like are used synonymously with being in a vertical direction, which is generally designated in the Z-direction in the figures. Furthermore, for the sake of clarity, the Y-direction has been oriented to point forward along a horizontal plane in the figures, the X-direction has been oriented to point left along the horizontal plane in the figures, and the Z-direction has been oriented to point upwards along a vertical plane in the figures. All of this is done realizing that such snow plow assemblies can be raised, lowered, inclined, declined, canted, etc., such as when being used on a vehicle.

Referring to FIGS. 1-7, an exemplary snow plow assembly 10 is shown. The snow plow assembly 10 generally includes a push frame 12 to which a moldboard 14 is mountable for enabling removal of snow, and a lift frame 16 configured for mounting to a vehicle 18. As discussed in further detail below, the snow plow assembly 10 also includes one or more couplings 20 configured to floatably attach the push frame 12 to the lift frame 16, which may enable the snow plow assembly 10 to improve snow removal by accommodating for irregular or uneven ground surfaces encountered by the vehicle 18 and/or snow plow assembly 10 when in use. Also as discussed in further detail below, the one or more couplings 20 may be configured to improve distribution of the loads exerted on portions of the push frame 12 to help reduce stress and wear.

In the illustrated embodiment, the snow plow assembly 10 includes a mounting bar 22 having one or more mounting interfaces 24, such as suitable brackets or the like, for operatively mounting the moldboard 14 to the push frame 12. As shown, the mounting bar 22 is pivotably connected to the push frame 12 via a suitable connection 26, such as via one or more brackets and bolts, for enabling lateral pivoting movement (e.g., left/right pivoting movement) of the mounting bar 22 relative to the push frame 12 about a vertical pivot axis 28. One or more pivot devices 30 may be connected to the left and/or right sides of the mounting bar 22, and connected to the left and/or right sides of the push frame 12, to enable the pivoting movement of the mounting bar 22 about the pivot axis 28. In the illustrated embodiment, the pivot devices 30 are fluid-operated piston-cylinder devices that may extend and retract to provide such pivoting movement to the mounting bar 22.

The moldboard 14 (shown diagrammatically in FIG. 1) may be any suitable type of moldboard or moldboard assembly, such as a straight moldboard, a V-shaped moldboard, or the like, and may have one or more plow blade edges for engaging the ground. The moldboard 14 may have corresponding mounting interfaces 32 for mounting to the mounting interfaces 24 of the mounting bar 22. It is understood that although the mount bar 22 is shown pivotably mounted to the push frame 12 for operatively coupling the moldboard 14, the moldboard 14 may be directly connected to the push frame 12, either removably or non-removably, and with or without pivoting movement, as may be desirable for particular applications.

In the illustrated embodiment, the push frame 12 is configured as an A-frame having rear crossbar 34 and a pair of side bars 36 arranged in a triangular or "A" configuration. The side bars 36 converge in the forward direction to form a vertex portion of the push frame, which may include the interface 26 for pivotably mounting the mounting bar 22. The rear crossbar 34 extends in a transverse direction and is operatively connected to the side bars 36 via any suitable means, such as welding or fastening. The push frame 12 also includes a pair of rearwardly projecting left and right ears 38 (also referred to as rearward projections) that are connected to the lateral sides of the rear cross bar 34. It is understood that although the push frame 12 is shown as being a multiple component construction, one or more of the components of the push frame 12 shown in the illustrated embodiment may be integral and unitary with each other.

The lift frame 16 is generally vertically oriented and includes an upper portion 40 that extends upright above the push frame 12, and a lower portion 42 that is coupled to the push frame 12. The lower portion 42 also is operatively coupled to the vehicle 18. In the illustrated embodiment, the lower portion 42 of the lift frame 16 includes mounting hooks 44 for removably mounting the lift frame 16 to a mount frame 46 (shown diagrammatically in FIG. 1) for quick secure attachment or removal of the plow assembly 10 without the use of tools. The mount frame 46 is operatively attached to the vehicle 18. The vehicle 18 may be any suitable vehicle, such as commercial, industrial, commuter, residential, or all-purpose vehicle. The mount frame 46 may be removably attached to the vehicle 18, or may be fixedly attached such as via welding to the vehicle frame in a manner well known in the art. The lift frame 16 also may include one or more stand assemblies 48 that are vertically pivotable downward to support at least a portion of the snow plow assembly 10, such as when the snow plow assembly 10 is detached from the vehicle 18. It is understood that although the lift frame 16 is shown as being removably mountable to a mount frame 46 via the hooks 44, the lift frame 16 could be directly removably mountable to the vehicle 18, or permanently attached to the vehicle 18, as may be desirable for particular applications.

The lift frame 16 includes a pair of vertical support members 50 that are transversely spaced apart frame one another. One or more transverse crossmembers 52, 54 may connect the vertical cross members 50 at the upper portion 40 of the lift frame 16. As shown, a lift device 56 is mounted to the lift frame 16 and is also operatively coupled to the push frame 12 such that activation of the lift device 56 vertically raises or lowers the push frame 12 and the moldboard 14 relative to a horizontal plane 58. In the illustrated embodiment, a forwardly extending lift arm 60 is operably coupled to one of the crossmembers 54, and a tether 62, such as a chain or other suitable linkage, operably connects the lift arm 16 to the push frame 12. The lift device 56 is coupled to the cross member 52 on one end of the lift device, and is connected to the lift arm 60 at the opposite end of the lift device 56. In the illustrated embodiment, the lift device 56 is a fluid operated piston-cylinder device in which extension or retraction of the device causes the lift arm 60 to pivot upwards or downwards relative to the crossmember 54 and the vertical support members 50, thereby causing the forward portion of the push frame 12 to raise or lower via the chain 62.

As shown, the lift frame 16 also may include a housing 64 that spans the space between the vertical support members 50. The housing 64 may contain electronic and/or fluid (e.g., hydraulic) devices and may act as a shield to the snow. As shown, one or more electrical conduits 66 and/or one or more fluid conduits 68 may extend from the housing 64 to provide a source of power to one or more of the pivot devices 30, lift device 56, and/or lights 70 (shown in FIG. 1). The housing 64 may contain one or more access panels 72 for accessing the internal chamber of the housing 64.

The lower portion of the lift frame 42 may include another crossmember 74 extending between the laterally spaced apart supports 50. One or more spring-loaded pins 76 may be operatively connected to the crossmember 74 and the supports 50 to facilitate transverse side-to-side movement of the lift frame 16 when the snow plow assembly is in use. As shown, the lift frame 16 may include inner lift frame members 78 and outer lift frame portions 80 that together form a clevis through which the spring-loaded pins 76 extend. The inner lift frame members 78 may be configured to engage the respective springs of the spring-loaded pins 76 to facilitate the lateral side-to-side movement. The inner lift frame members 78 and the outer lift frame portions 80 may each have the hooks 44 for removably mounting the lift frame 16 to the mounting frame 46, as discussed above. In addition, the inner lift frame members 78 and the outer lift frame portions 80 may cooperate with each other to couple the lift frame 16 to the push frame 12 via the couplings 20, as discussed in further detail below. It is understood that although the lift frame 16 is shown as being a multiple component construction, one or more of the components of the lift frame 16 shown in the illustrated embodiment may be integral and unitary with each other as may be desired.

Referring particularly to FIGS. 8-11, with reference to FIGS. 1-7, the coupling(s) 20 are shown in further detail. As shown, the snow plow assembly 10 may include first and second couplings 20*a* and 20*b* (collectively referred to herein as couplings 20), with the first coupling 20*a* attaching a left side of the push frame 12 to a corresponding left side of the lift frame 16, and the second coupling 20*b* attaching a right side of the push frame to a corresponding right side of the lift frame. As discussed above, the couplings 20*a* and 20*b* may be configured to allow each of the left and right sides of the push frame 12 to float vertically relative to the respective left and right sides of the lift frame 16 (as designated by the vertical arrows in FIG. 2 and FIG. 8). The couplings 20*a* and 20*b* also may be configured to allow the left and right sides of the push frame 12 to float vertically independently of one another. This independent floating movement of each of the couplings 20*a* and 20*b* allows the push frame 12 to rotate relative to the lift frame 16 about a longitudinal axis 82 (as designated by the arc-shaped double arrow in FIG. 2), which enables the snow plow assembly 10 to accommodate for irregular or uneven ground surfaces when the snow plow assembly is in use. As discussed in further detail below, the couplings 20 also may be configured to facilitate distribution of pushing or pulling loads on the push frame 12 where high concentration of stresses are likely to occur, which allows the couplings 20 to help reduce wear on the push frame 12.

In the illustrated embodiment, the couplings 20 each include a retaining member 84 for operatively coupling the push frame 12 to the lift frame 16. As shown, the rearwardly extending portion 38 of the push frame 12 includes a vertically elongated slot 86 defined by inner surfaces 88 of the push frame 12. The vertical slot 86 is configured to receive the retaining member 84 and allows the retaining member 84 to move vertically up and down within the vertical slot 86 to permit the respective left and right sides of the push frame 12 to float vertically, and independently, relative to the corresponding left and right sides of the lift frame 16. In the illustrated embodiment, the upper and lower portions of the inner surfaces 88 of the vertical slot 86 may act as vertical stops that restrict the vertical floating movement of the retaining member 84.

As shown, the couplings 20 also may include at least one bearing block 90 at least partially interposed between the retaining member 84 and the push frame 12 in the forward and/or rearward longitudinal directions. In the illustrated embodiment, the bearing block 90 has a through-hole 92 defined by inner surfaces 94 configured to receive the retaining member 84 in the transverse direction. In this manner, the retaining member 84 may extend through the through-hole 92 in the bearing block 90 and extends into the vertically elongated slot 86 of the push frame 12. Generally, the retaining member 84 may have a relatively tight fit with the inner surfaces 94 defining the through-hole 92 of the bearing block 90, and may have a relatively loose fit with the inner surfaces 88 defining the vertical slot 86 of the push frame 12. This may allow the retaining member 84 to preferentially engage and exert force against the inner surfaces 94 of the bearing block 90 when pushing or pulling loads are exerted on the snow plow assembly 10, while restricting or limiting the engagement of the retaining member 94 against the inner surfaces 88 of the push frame 12, which may reduce wear on the inner surfaces 88 of the vertical slot 86.

The bearing block(s) 90 also may be configured to enhance distribution of loads between the push frame 12 and the retaining member 84 by distributing the pushing and pulling loads exerted on the push frame 12 over a greater area for reducing wear on the push frame 12. For example, in the illustrated embodiment, the push frame 12 includes longitudinally spaced apart stops 96 between which the bearing block 90 is disposed for engagement with the stops 96 when the pushing and pulling loads are exerted on the push frame 12. In this manner, the forces exerted on the push frame 12 are transferred to the bearing block(s) 90 through the stops, and are then transferred through the bearing block(s) 90 to the retaining member 84 and then to lift frame 16 which is operably supported by the vehicle 18.

To reduce the concentration of forces on portions of the push frame 12, the bearing surfaces 98 of the stops 96 which contact the bearing surfaces 100 of the bearing block(s) 90 may have a contact area that is greater than the area of contact between the bearing block(s) 90 and the retaining member 94. The bearing block 90 also may have a tighter fit between the stops 96 (e.g., less longitudinal spacing or slack) than the retaining member 84 has within the vertical slot 86 of the push frame, such that as the load is exerted on the push frame 12, the limited slack between the push frame stops 96 and the bearing block(s) 90 preferentially allows the load to be transmitted through the bearing block(s) 90, rather than allowing the retaining member 84 to engage the inner surfaces 88 of the vertical slot 86. Because the bearing block(s) 90 may be configured to take a higher concentration of the load in those locations where the bearing block 90 engages the retaining member 84 (e.g., at the inner surfaces 94 of the through-hole 92), the bearing block 90 may have an increased amount of wear compared to the engagement portions of the push frame 12 (e.g., the stops 96). The bearing block 90, however, may be a relatively inexpensive and easy to replace component compared to the push frame 12, and thus the bearing block 90 may be considered a sacrificial and replaceable wear block. In some embodiments, the stops 96 of the push frame also may be removably mountable to allow for replacement of the stops 96, however, it is also understood that the stops 96 may be fixedly attached to the rearward projections of the push frame 38, such as via welding or other suitable attachment.

The bearing block(s) 90 also may be configured to enable the vertical floating movement of the push frame 12 relative to the lift frame 16. For example, in the illustrated embodiment, each of the longitudinally spaced apart stops 96 extend in the vertical direction to form a vertical guide slot within which the bearing block 90 is slidably disposed. In this manner, the bearing blocks 90 may be configured to engage the stops 96 while sliding vertically within the vertical guide slot as the retaining member 84 moves vertically within the vertically elongated slot 86 of the push frame 12. In the illustrated embodiment, the forward and rearward bearing surfaces 100 of the bearing block 90 are vertically oriented such that the bearing surfaces 100 of the bearing block 90 and the bearing surfaces 98 of the vertically elongated stops 96 are all parallel to each other in the vertical direction. Such a configuration of the bearing block 90 also increases the effective contact area with the stops 96 to reduce force concentrations as discussed above. In the illustrated embodiment, the bearing block 90 is a relatively easy to manufacture component having a generally parallelepiped or rounded-square shape, in which its thickness in the transverse direction is less than a width of at least one of its sides.

As shown, each of the couplings 20*a* and 20*b* attaching the left and right sides of the push frame 12 to the lift frame 16 may have more than one bearing block 90 disposed between a set of stops 96 of the push frame, which may further increase the contact area between the bearing blocks 90 and the push frame 12 to further reduce the concentration of forces and wear on the push frame 12. In the illustrated embodiment, each coupling 20*a* and 20*b* has two bearing blocks 90 and 91 slidably disposed between vertical stops 96 and 97 on opposite inner and outer sides of the rearward projection 38 of the push frame 12. In such a configuration, the vertically elongated slot 86 of the push frame 12 may be configured as a through-slot that extends in the transverse direction through the rearward projection 38 of the push frame 12, such that the retaining member 84 may extend through the through-hole 92 in the outer bearing block 90, through the vertically elongated through-slot 86 interposed between the bearing blocks 90 and 91, and then through the through hole 93 in the inner bearing block 91. In this manner, each of the outer and inner bearing blocks 90, 91 may be configured to transmit and distribute load between different portions of the push frame (e.g., the inner and outer stops 96, 97) and different portions of the retaining member 94. In addition, each of the outer and inner bearing blocks 90, 91 may be configured to vertically slide within the vertically elongated inner and outer guide slots formed between the respective stops 96, 97 to enable the floating movement of the respective couplings 20*a* and 20*b*, as discussed above.

In the illustrated embodiment, the retaining member 84 is configured to protrude outwardly of the outer bearing block 90 and is configured to protrude inwardly of inner bearing block 91 to allow for connection to respective inner and/or outer portions of the lift frame 16. In the illustrated embodiment, the lift frame 16 forms a clevis with the inner lift frame member 78 (inner portion) and the outer lift frame portion 80, and each of the inner and outer portions of the lift frame have a through-hole 102, 103 through which the retaining member 84 extends for operatively coupling the push frame 12 to the lift frame 16. In the illustrated embodiment, the retaining member 84 is configured as a cylindrical pin having a head 104 on one end and a catch 106, such as a cotter pin, on the opposite end. The head 104 may be sized greater than the size of the through hole 102 in the lift frame outer portion to restrict too much inward lateral movement of the retaining member 84, and the catch 106, which may cooperate with a washer 108, may be configured to engage the inner portion 78 of the lift frame to restrict too much outward lateral movement of the retaining member 84. The retaining member 84 is preferably configured with a sufficient size and made of a suitable material to withstand the loads exerted on the pin without significant plastic deformation when the snow plow assembly is in use.

It is understood that although a preferred configuration of the exemplary snow plow assembly 10 including the floating coupling(s) 20 has been described and shown, it would be apparent to those having ordinary skill in the art that other push frame 12 and/or lift frame 16 designs could also be used with the present invention. The invention is not limited to any particular snow plow assembly design, but rather is appropriate for a wide variety of commercially-available snow plow assemblies. Furthermore, although the principles and aspects of the present invention have particular application to snow plow assemblies, it is understood that such principles and aspects may be applicable to other plow assemblies in general, or to other vehicle mounted or machine accessories upon which forces are exerted and which may be desirable to provide one or more floatable couplings that allow independent movement relative to each other and/or cooperate to provide rotational movement, and/or where it is desirable to provide one or more bearing blocks in the coupling to improve the load distribution, such as for vehicle-mounted rotating brushes, or the like.

It is furthermore understood that although a preferred exemplary embodiment of the coupling 20 has been shown and described, other suitable alternatives are possible. For example, although the retaining member 84 and bearing block(s) 90 are shown as being vertically movable relative to the push frame 12 and fixed in position relative to the lift frame 16, these features could instead be reversed to allow the retaining member 84 and/or bearing block(s) 90 to be vertically movable relative to the lift frame 16 while being fixed in position relative to the push frame 12. In such a situation, the lift frame 12 may have the vertically elongated slot 86 and/or the one or more vertical guide slots formed by the stops 96, 97 as described above.

It is furthermore understood that although the retaining member 84 is shown as extending all the way through the vertical slot 86 (configured as a through-slot) in the push frame 12, the vertical slot 86 could instead be configured as a vertical groove within which an end of the retaining member 84 could move without projecting therethrough. Furthermore, in some embodiments, the coupling 20 may include the retaining member 84 slidably engaging the inner surfaces 88 of the vertical groove 86 to provide the floating and rotation features discussed above without the bearing block(s) 90, 91. The bearing block 90 is beneficial, however, in distributing the load as discussed above, and it is noted that the ability of the retaining member 84 to extend through the vertical through-slot 86 facilitates the use of multiple bearing blocks 90, 91 to further enhance load distribution.

It is also understood that the push frame 12 could be devoid of the vertical slot 86, in which case the coupling 20 could be configured with the retaining member 84 disposed in the bearing block 90 and the bearing block 90 configured to be slidable within the vertical guide slot formed by the stops 96 to provide the vertical floating features discussed above. Alternatively, it is also understood that the bearing block(s) 90, 91 could be provided without being slidable for enhancing the wear performance as discussed above without the floatable features.

As used herein, an "operable connection," or a connection by which entities are "operably connected," is one in which the entities are connected in such a way that the entities may perform as intended. An operable connection may be a direct connection or an indirect connection in which an intermediate entity or entities cooperate or otherwise are part of the connection or are in between the operably connected entities.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A snow plow assembly for a vehicle, the snow plow assembly comprising:

a push frame to which a moldboard is mountable for enabling removal of snow;

a lift frame configured for mounting to the vehicle;

a lift device mounted to the lift frame, the lift device configured to vertically raise or lower the push frame and the moldboard relative to a horizontal plane; and a first coupling and a second coupling, the first coupling attaching a left side of the push frame to a corresponding left side of the lift frame, and the second coupling attaching a right side of the push frame to a corresponding right side of the lift frame;

wherein the first and second couplings each include a bearing block having an opening that receives a retaining member that operatively couples the push frame to the lift frame; and wherein the respective bearing blocks of the first and second couplings are configured to vertically move with the respective retaining members when the snow plow assembly is in use to thereby allow each of the left and right sides of the push frame to float vertically relative to the respective left and right sides of the lift frame, and are configured to allow the left and right sides of the push frame to float vertically independently of one another, thereby allowing the push frame to rotate relative to the lift frame about a longitudinal axis extending in a forward direction, which enables the snow plow assembly to accommodate for irregular or uneven ground surfaces when the snow plow assembly is in use.

2. The snow plow assembly according to claim 1, wherein the left and right sides of the push frame each includes a vertically elongated slot configured to receive the corresponding retaining member, the retaining member being configured to move vertically within the vertically elongated slot to permit the respective left and right sides of the push frame to float vertically relative to the corresponding left and right sides of the lift frame.

3. The snow plow assembly according to claim 2, wherein the respective bearing blocks are configured to distribute at least some load exerted on the push frame to the respective retaining members, thereby reducing wear on the push frame when the snow plow assembly is in use.

4. The snow plow assembly according to claim 1, wherein each of the left and right sides of the push frame has a vertical guide slot having a pair of vertically elongated stops spaced apart in the longitudinal forward direction; and wherein the bearing blocks are slidably disposed in the vertical guide slots, and the bearing blocks are configured to slide vertically within the vertical guide slot as the retaining member slides vertically within the vertically elongated slot.

5. The snow plow assembly according to claim 4, wherein the bearing block has forward and rearward vertically extending bearing surfaces, the vertically extending bearing surfaces of the bearing block being configured to slidably engage corresponding bearing surfaces of the vertically elongated stops of the vertical guide slot; and wherein the vertically extending bearing surfaces of the bearing block and the bearing surfaces of the vertically elongated stops are all parallel to each other in the vertical direction.

6. The snow plow assembly according to claim 4, wherein each of the bearing blocks has a through-hole configured to receive the retaining member in a transverse horizontal direction that is transverse to the longitudinal forward direction; and wherein the retaining member is configured to extend through the through-hole in the bearing block and extend into the vertically elongated slot of the push frame to allow the retaining member to move vertically within the vertically elongated slot.

7. The snow plow assembly according to claim 5, wherein each of the vertically elongated slots of the push frame is configured as a vertically elongated through-slot that extends through the push frame in the transverse horizontal direction; and wherein the retaining member extends in the transverse direction through the vertically elongated through-slot to protrude both outwardly and inwardly of a portion of the push frame having the vertically elongated slot.

8. The snow plow assembly according to claim 7, wherein the lift frame is operatively coupled to a portion of the retaining member that protrudes outwardly of the portion of the push frame and/or is operatively coupled to a portion of the retaining member that protrudes inwardly of the portion of the push frame.

9. The snow plow assembly according to claim 1, wherein the left and right sides of the push frame each has a rearward projection extending in the longitudinal forward direction, the rearward projections each having a vertically extending through-slot that extends through the rearward projection in a transverse horizontal direction that is transverse to the forward direction;

wherein the rearward projections each has an inner vertical guide slot at an inner portion of the rearward projection, and has an outer vertical guide slot at an outer portion of the rearward projection, each of the inner and outer vertical guide slots having a pair of stops extending in the vertical direction and being spaced apart in the longitudinal forward direction;

wherein the bearing block of each of the first and second couplings is an inner bearing block, the first and second couplings each including an outer bearing block, the inner bearing block being slidably disposed in the inner vertical guide slot, and the outer bearing block being slidably disposed in the outer vertical guide slot, such that a portion of the rearward projection having the vertically extending through slot is transversely interposed between the inner and outer bearing blocks;

wherein each of the inner and outer bearing blocks has a through-hole extending in the transverse horizontal direction;

wherein the retaining member extends in the transverse horizontal direction through the respective through-holes in the inner bearing block and the outer bearing block, and through the vertically elongated through-slot transversely interposed between the inner and outer bearing blocks, in which the respective inner and outer bearing blocks are configured to distribute at least some load exerted on the push frame to the retaining member; and wherein the retaining member is configured to move vertically within the vertically elongated through-slot, and the inner and outer bearing blocks are configured to slide vertically within the respective inner and outer vertical guide slots as the retaining member moves vertically within the vertically elongated through-slot, in which each of the left and right sides of the push frame are allowed to float vertically, independently of one another, relative to the respective left and right sides of the lift frame to allow rotational movement of the push frame relative to the lift frame.

10. The snow plow assembly according to claim 9, wherein each of the left and right sides of the lift frame has an inner portion and an outer portion, the outer portion being spaced apart from the inner portion in the transverse horizontal direction;

wherein the outer portion of the lift frame is disposed outwardly of the outer bearing block, and the inner portion of the lift frame is disposed inwardly of the inner bearing block, such that the rearward projection of the push frame and the inner and outer bearing blocks are transversely interposed between the inner and outer portions of the lift frame;

wherein the outer portion of the lift frame has a through-hole in alignment with the through-hole of the outer bearing block, and the inner portion of the lift frame has a through-hole in alignment with the through-hole of the inner bearing block; and wherein the retaining member extends through the respective through-holes of the inner and outer portions of the lift frame to couple the lift frame to the push frame.

11. The snow plow assembly according to claim 1, wherein the push frame is configured as an A-frame having a forward vertex portion and transversely spaced apart left and right rearward portions;

wherein the forward vertex portion includes an interface for pivotably connecting a mounting bar to which the moldboard is mountable; and wherein the first and second couplings respectively connect the left and right rearward portions of the A-frame to the corresponding left and right sides of the lift frame.

12. The snow plow assembly according to claim 11, wherein the snow plow assembly further includes one or more pivot devices connected to the push frame and the mounting bar for pivoting the mounting bar relative to the push frame.

13. The snow plow assembly according to claim 1, wherein the lift frame has an upper portion that extends upright above the push frame, the upper portion having the lift device mounted thereon, and including a lift arm connected to the lift device, the lift arm having a tether connected to a forward end portion thereof, the tether being connected to a forward portion of the push frame such that extension of the lift device raises or lowers the push frame.

14. The snow plow assembly according to claim 13, wherein the lift frame further includes one or more spring-loaded pins that are configured to permit transverse movement of the lift frame when the snow plow assembly is in use.

15. The snow plow assembly according to claim 13, wherein the upper portion of the lift frame includes a pair of vertical support members, the vertical support members being transversely spaced apart frame one another, and the lift frame further including a housing that spans the space between the vertical support members.

16. The snow plow assembly according to claim 1, wherein for each of the first coupling and the second coupling, the bearing block is at least partially interposed between the push frame and the retaining member in both a longitudinal rearward direction and a longitudinal forward direction to cause the retaining member to preferentially engage the bearing block, while restricting the retaining member from engaging the push frame, when the snow plow assembly is pushing or pulling snow.

17. A snow plow assembly for a vehicle, the snow plow assembly comprising:

a push frame to which a moldboard is mountable for enabling removal of snow;

a lift frame configured for mounting to the vehicle;

a lift device mounted to the lift frame, the lift device configured to vertically raise or lower the push frame and the moldboard relative to a horizontal plane; and a coupling configured to couple the push frame to the lift frame, the coupling including a bearing block and a retaining member;

wherein the retaining member is configured to operatively couple the push frame to the lift frame while permitting the push frame to float vertically relative to the lift frame, wherein the bearing block is interposed between the retaining member and the push frame, the bearing block being configured to distribute at least some load exerted on the push frame to the retaining member, thereby reducing wear on the push frame when the snow plow assembly is in use, and;

wherein the bearing block is at least partially interposed between the push frame and the retaining member in both a longitudinal rearward direction and a longitudinal forward direction to cause the retaining member to preferentially engage the bearing block, while restricting the retaining member from engaging the push frame, when the snow plow assembly is pushing or pulling snow.

18. The snow plow assembly according to claim 17, wherein the bearing block has forward and rearward outer bearing surfaces configured to engage corresponding forward and rearward portions of the push frame, and has forward and rearward inner bearing surfaces configured to engage corresponding portions of the retaining member; and wherein a surface area of each of the forward and rearward outer bearing surfaces is greater than a surface area of each of the forward and rearward inner bearing surfaces for minimizing force concentration on the push frame, thereby limiting wear of the push frame and preferentially causing wear of the bearing block.

19. A snow plow assembly, comprising:

a mounting bar having one or more mounting interfaces for coupling to a moldboard assembly;

an A-frame having a forward vertex portion and left and right rearward portions laterally spaced apart in the transverse horizontal direction, the forward vertex portion having an interface for pivotably connecting a portion of the mounting bar for enabling lateral pivoting movement of the mounting bar relative to the A-frame;

a lift frame having an upper portion that extends upright above the A-frame and the mounting bar, the upper portion having a forwardly extending lift arm connected to a lift device, the lift arm being operably connected to a portion of the A-frame, such that activation of the lift device vertically raises or lowers the A-frame and the mounting bar relative to a horizontal plane; and a first coupling and a second coupling, the first coupling attaching the left rearward portion of the A-frame to a corresponding left portion of the lift frame, and the second coupling attaching a right rearward portion of the A-frame to a corresponding right portion of the lift frame;

wherein each of the first coupling and the second coupling include a bearing block having an opening that receives a retaining member that operatively couples the push frame to the lift frame, wherein the respective bearing blocks of the first and second couplings are configured to vertically move with the respective retaining members when the snow plow assembly is in use to thereby allow each of the left and right rearward portions of the push frame to float vertically relative to the corresponding left and right portions of the lift frame, and are configured to allow the left and right rearward portions of the push frame to float vertically independently of one another, thereby allowing the push frame to rotate relative to the lift frame about a longitudinal axis extending in a forward direction to accommodate for irregular or uneven ground surfaces when the snow plow assembly is in use; and wherein for each of the first coupling and the second coupling, the bearing block is interposed between the retaining member and the corresponding left or right rearward portion of the push frame, the respective bearing blocks being configured to distribute at least some load exerted on the push frame to the respective retaining members, thereby reducing wear on the push frame when the snow plow assembly is in use.

20. The snow plow assembly according to claim 19, wherein for each of the first coupling and the second coupling, the bearing block is at least partially interposed between the push frame and the retaining member in both a longitudinal rearward direction and a longitudinal forward direction to cause the retaining member to preferentially engage the bearing block, while restricting the retaining member from engaging the push frame, when the snow plow assembly is pushing or pulling snow.

* * * * *